US010980318B2

(12) United States Patent
Wang

(10) Patent No.: US 10,980,318 B2
(45) Date of Patent: Apr. 20, 2021

(54) PROCESS FOR MANUFACTURING WATERPROOF AND VAPOR-PERMEABLE SHOE

(71) Applicant: VESSI FOOTWEAR LTD., Vancouver (CA)

(72) Inventor: Szu-Kai Wang, Taichung (TW)

(73) Assignee: VESSI FOOTWEAR LTD., Vancouver (CA)

( * ) Notice: Subject to any disclaimer, the term of this patent is extended or adjusted under 35 U.S.C. 154(b) by 257 days.

(21) Appl. No.: 16/353,222

(22) Filed: Mar. 14, 2019

(65) Prior Publication Data

US 2020/0288815 A1 Sep. 17, 2020

(51) Int. Cl.

| | |
|---|---|
| ***A43B 23/02*** | (2006.01) |
| ***A43D 25/18*** | (2006.01) |
| ***A43D 8/02*** | (2006.01) |
| ***A43B 1/14*** | (2006.01) |

(52) U.S. Cl.

CPC ..... *A43D 25/18* (2013.01); *A43B 1/14* (2013.01); *A43B 23/025* (2013.01); *A43B 23/026* (2013.01); *A43D 8/02* (2013.01)

(58) Field of Classification Search

CPC . A43B 23/0255; A43B 23/026; A43B 23/022; A43B 7/125; A43B 1/14; A43D 25/18; A43D 25/20

See application file for complete search history.

(56) References Cited

U.S. PATENT DOCUMENTS

| | | | | |
|---|---|---|---|---|
| 2016/0000176 | A1* | 1/2016 | Peikert | A43B 23/0235 36/3 A |
| 2018/0020770 | A1* | 1/2018 | Chang | A43B 23/026 12/142 T |
| 2019/0098961 | A1* | 4/2019 | Chang | A43B 23/0235 |
| 2019/0223545 | A1* | 7/2019 | Chang | A43B 23/0255 |
| 2020/0068992 | A1* | 3/2020 | Hsiao | A43B 23/022 |

* cited by examiner

*Primary Examiner* — Ted Kavanaugh

(74) *Attorney, Agent, or Firm* — Hamre, Schumann, Mueller & Larson, P.C.

(57) ABSTRACT

A process for manufacturing a waterproof and vapor-permeable shoe is provided. In the process, an adhesive layer is provided on a knitted fabric to form a laminate, and a shoe upper unit is formed from the laminate, and has an adhesive component defining an inner space of the shoe upper unit. A shoe lining member, which is worn on a last, is placed into the shoe upper unit to permit a knitted component of the shoe upper unit to be bonded to the shoe lining member through the adhesive component under a heating treatment.

12 Claims, 21 Drawing Sheets

PROCESS FOR MANUFACTURING WATERPROOF AND VAPOR-PERMEABLE SHOE

FIELD

The disclosure relates to a process for manufacturing a shoe, more particularly to a process for manufacturing a waterproof and vapor-permeable shoe.

BACKGROUND

Knitted shoes may each include a knitted shoe upper unit, a shoe lining disposed inside the knitted shoe upper unit, and a sole unit mounted beneath the knitted shoe upper unit. Compared to normal shoes, the knitted shoes enable a more comfortable wearing experience. In a conventional process for making the knitted shoe, adhesive is sprayed on an inner surface of the knitted shoe upper unit and an outer surface of the shoe lining ahead of time so as to allow the bonding between the knitted shoe upper unit and the shoe lining. However, the adhesive spraying may result in air pollution.

In addition, although a desire pattern may be formed on the knitted shoe upper unit using a computer controlled knitting machine, the formation of the computer knitted pattern may be adverse to the lowering of the manufacturing cycle time and the reduction of the production cost.

SUMMARY

Therefore, an object of the disclosure is to provide a novel process for manufacturing a waterproof and vapor-permeable shoe, which may overcome at least one of the aforesaid drawbacks.

According to the disclosure, a process for manufacturing a waterproof and vapor-permeable shoe includes the steps of:

(a) providing an adhesive layer on a first major surface of a knitted fabric to form a laminate;

(b) cutting from the laminate at least one piece for forming a shoe upper unit, the at least one piece having a knitted component and an adhesive component;

(c) forming the at least one piece into the shoe upper unit in such a manner that the shoe upper unit has a first ankle opening and a first closed bottom, and that the adhesive component constitutes an inner surface of the shoe upper unit which defines an inner space;

(d) wearing a shoe lining member on a last to permit the shoe lining member to have an outer profile corresponding to an inner profile of shoe upper unit, the shoe lining member having a second ankle opening and. a second closed bottom, and including a shoe lining layer and a waterproof and vapor-permeable layer which is disposed outwardly of the shoe ng layer to define the outer profile of the shoe lining member;

(e) placing the shoe lining member, which is worn on the last, into the shoe upper unit through the first ankle opening to permit the waterproof and vapor-permeable layer to be in contact with the adhesive component;

(f) heating the shoe upper unit and the shoe lining member to permit the adhesive component to bond the waterproof and vapor-permeable layer and the knitted component together; and (g) bonding a sole unit to the first closed bottom of the shoe upper unit.

In the process of the disclosure, because the adhesive layer (the adhesive component) is formed on the knitted fabric (the knitted component) prior to the cutting step, the knitted component of the shoe upper unit can be bonded to the shoe lining member through the adhesive component without using a spraying adhesive. In addition, the shoe upper unit can be formed by stitching the at least one piece, which is cut from the laminate, into a three dimension structure. Therefore, the process of the disclosure may be useful for the lowering of the manufacturing cycle time and the reduction of the production cost.

BRIEF DESCRIPTION OF THE DRAWINGS

Other features and advantages of the disclosure will become apparent in the following detailed description of the embodiment (s) with reference to the accompanying drawings, in which.

DETAILED DESCRIPTION

Figure 1:
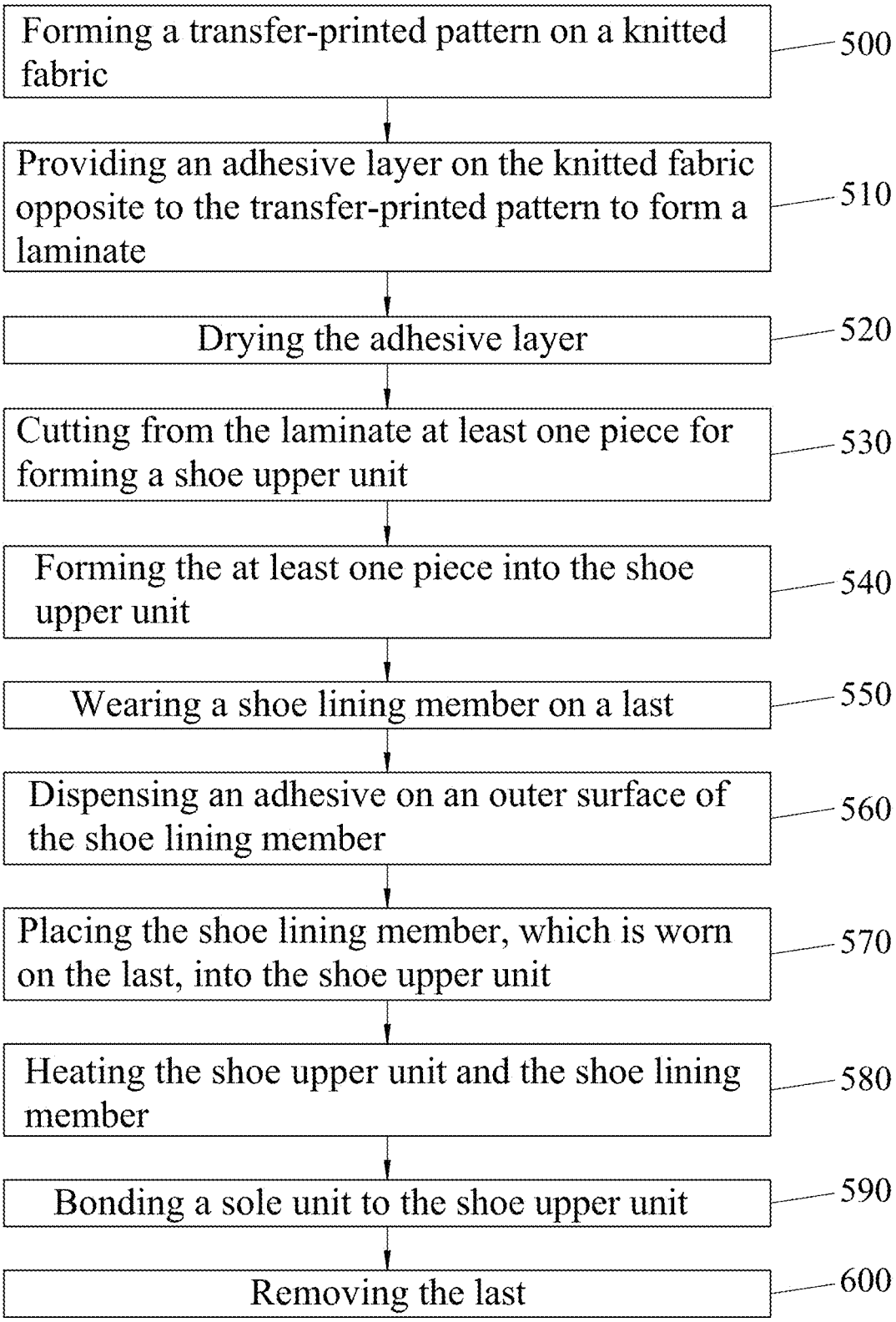
FIG. 1 is a block diagram illustrating a process for manufacturing a waterproof and vapor-permeable shoe according to the disclosure.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Referring to FIG. 1, a process for manufacturing a waterproof and vapor-permeable shoe 400 (shown in FIG. 14) according to a first embodiment of the disclosure is shown to include steps 500, 510, 520, 530, 540, 550, 560, 570, 580, 590, and 600.

Figure 2:
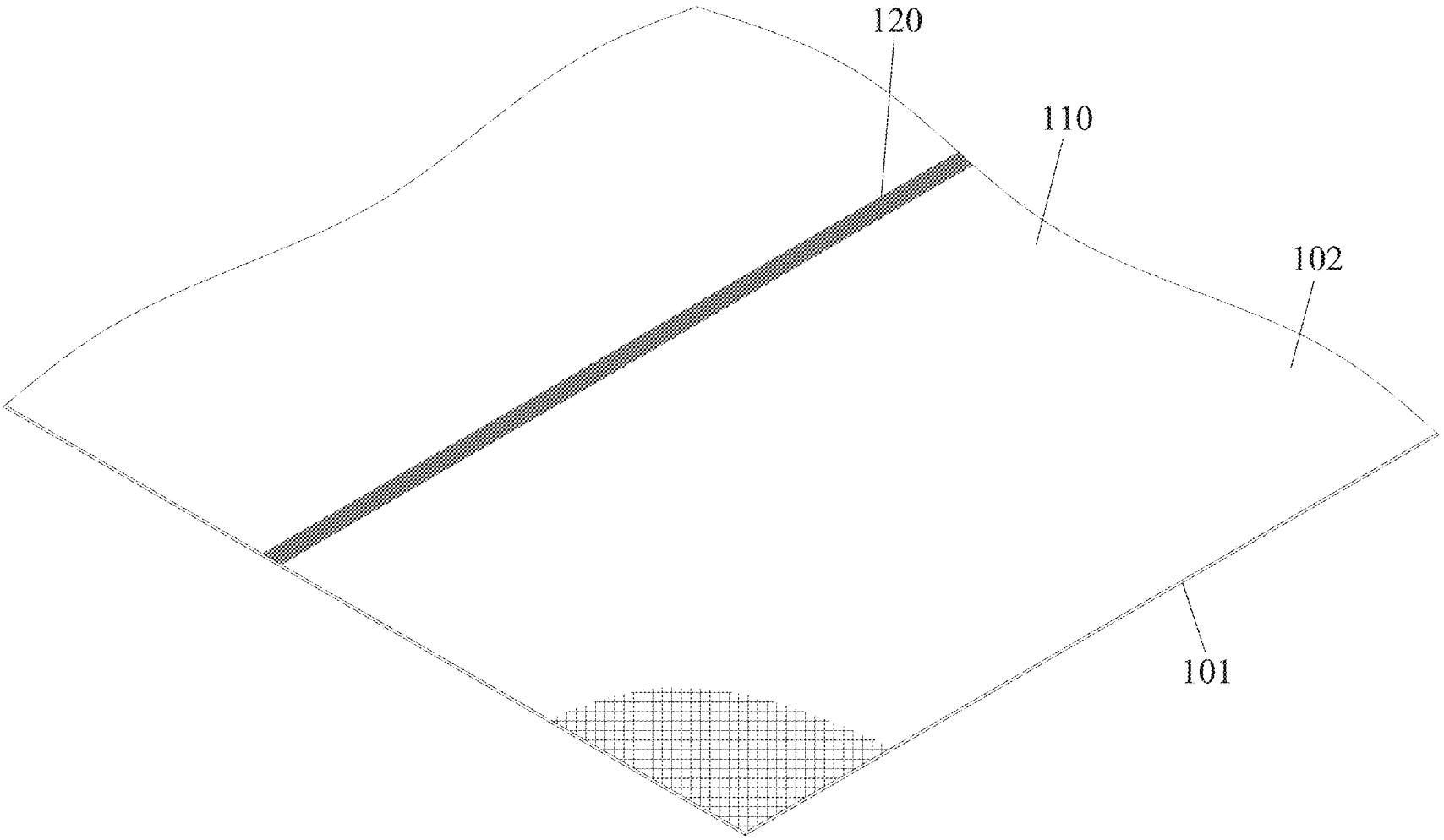
FIG. 2 is a fragmentary perspective view illustrating a transfer printed pattern formed on a second major surface of a knitted fabric in the process of the disclosure.

In step 500, as shown in FIGS. 1 and 2, a knitted fabric 110, which has first and second major surfaces 101, 102 that are opposite to each other, is prepared, and a transfer-printed pattern 120 is formed on the second major surface 102 of the knitted fabric 110 using a transfer printing technique.

Figure 3:
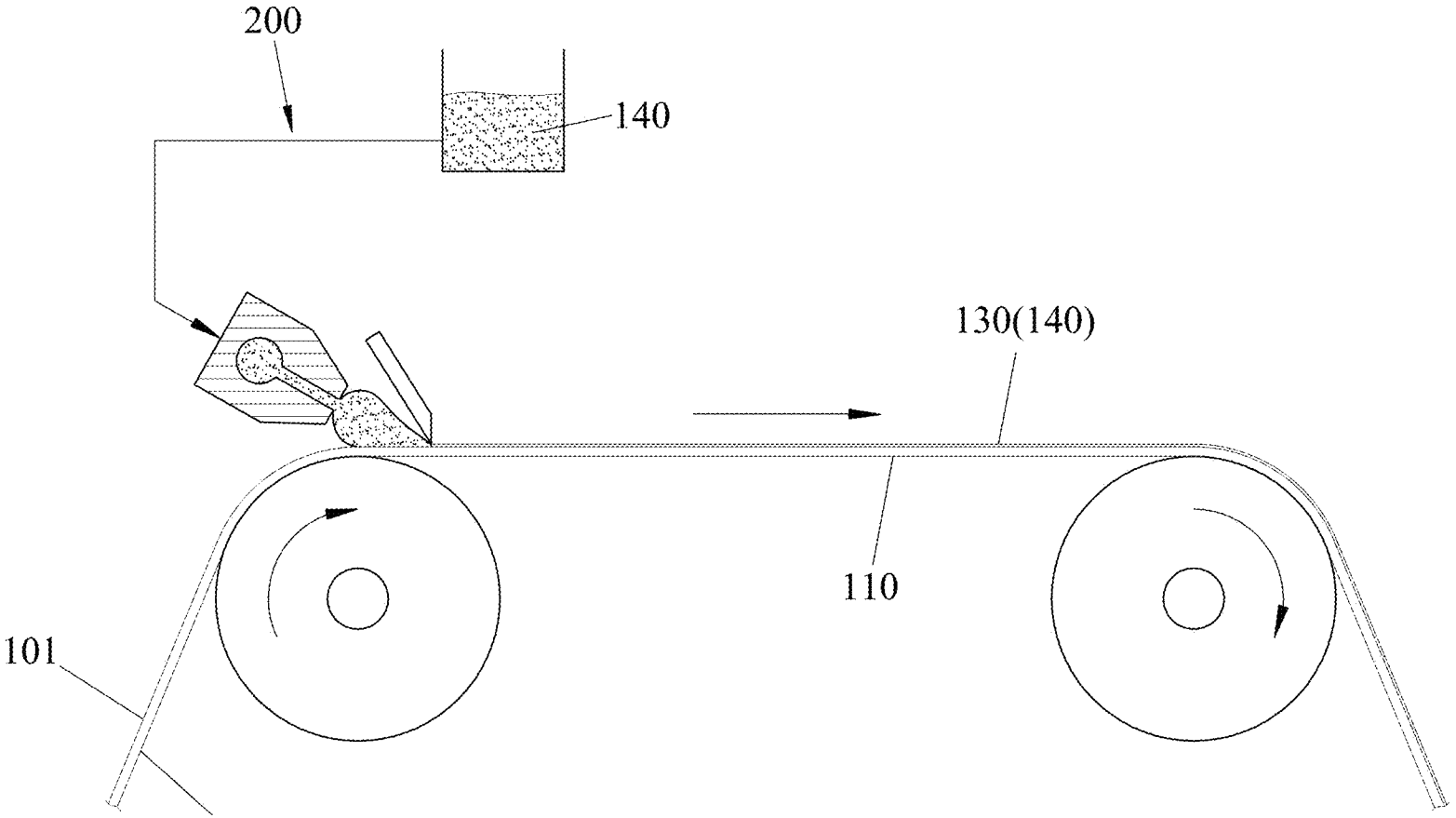
FIG. 3 is a schematic view illustrating how an adhesive layer is formed on a first major surface of the knitted fabric in the process of the disclosure.
Figure 4:
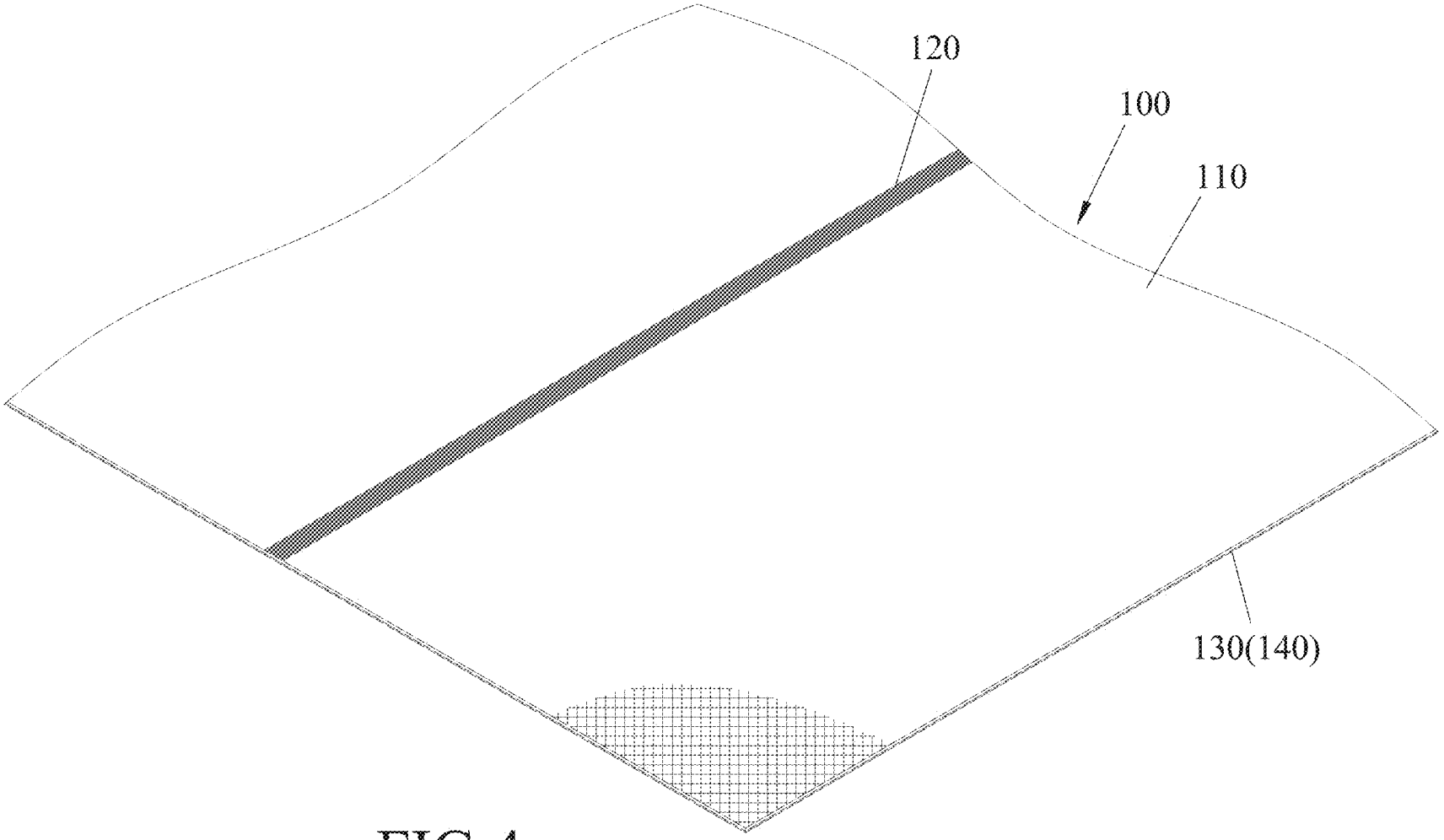
FIG. 4 is a fragmentary perspective view of a laminate obtained in the process of the disclosure.

In step 510, as shown in FIGS. 1, 3, and 4, an adhesive layer 130 is provided on the first major surface 101 of the knitted fabric 110 to form a laminate 100.

In an embodiment shown in FIG. 3, step 510 is implemented by applying adhesive material 140 on the first major surface 101 of the knitted fabric 110 using a roller coating machine 200 to form the adhesive layer 130. The adhesive material 140 may include, but is not limited to, polyurethane adhesive. In other embodiments, the adhesive layer 130 may be a hot-melt film adhesive which may be directly adhered on the first major surface 101 of the knitted fabric 110.

In step 520 (see FIG. 1), the adhesive layer 130 shown in FIG. 4 is subjected to a drying treatment.

In an embodiment, the adhesive layer 130 in step 520 is dried at a temperature ranging from 90° C. to 160° C. for a time period ranging from 3 minutes to 5 minutes.

In other embodiment, the adhesive layer 130 in step 520 may be dried at room temperature for 24 hours.

Please note that in the case that the hot-melt film adhesive is used as the adhesive layer 130, it is not necessary to dry the adhesive layer 130, and step 520 thus may be omitted.

Figure 5:
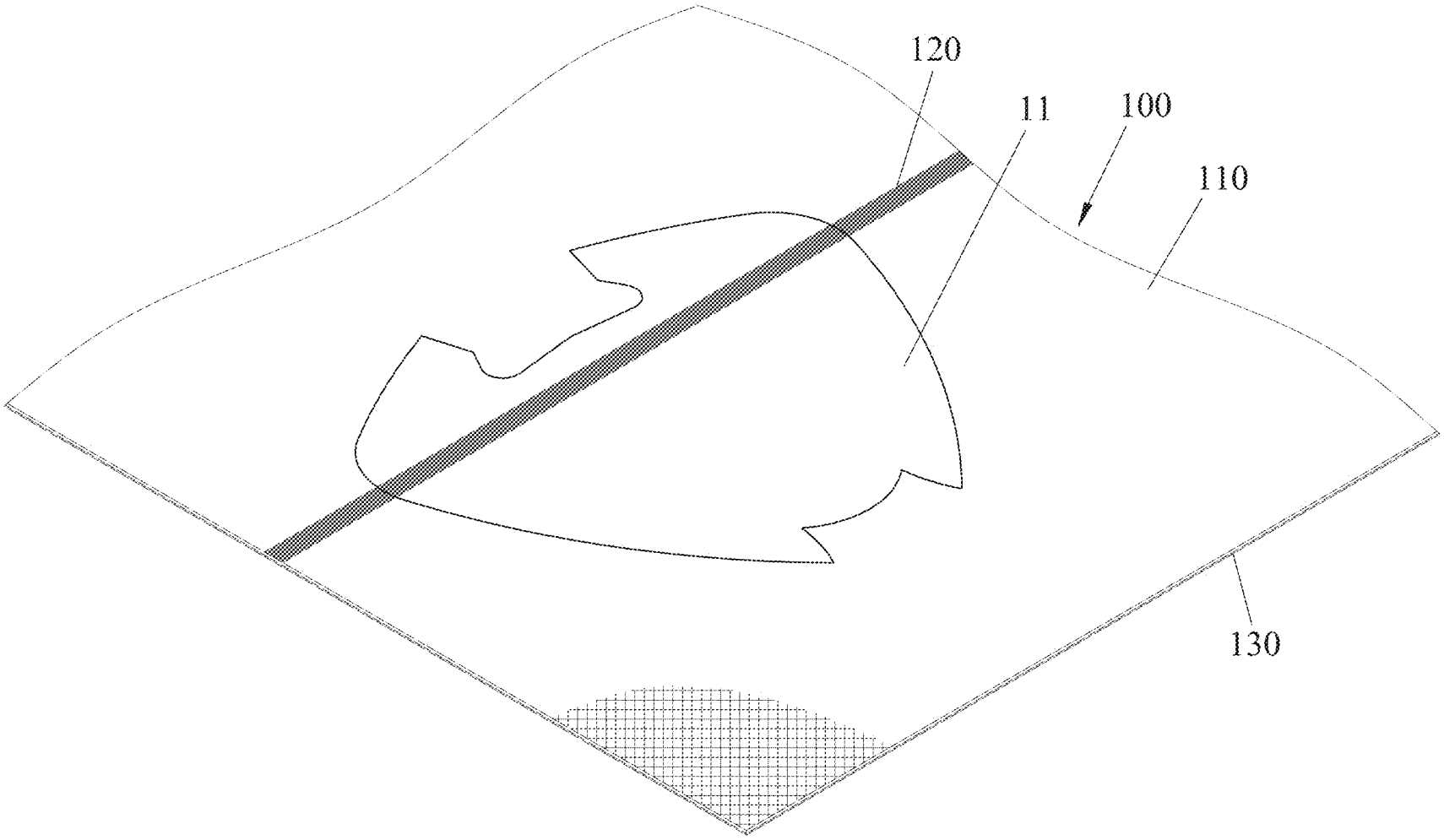
FIG. 5 is similar to FIG. 4 but illustrating a profile of a piece cut from the laminate in a process according to a first embodiment of the disclosure.
Figure 6:
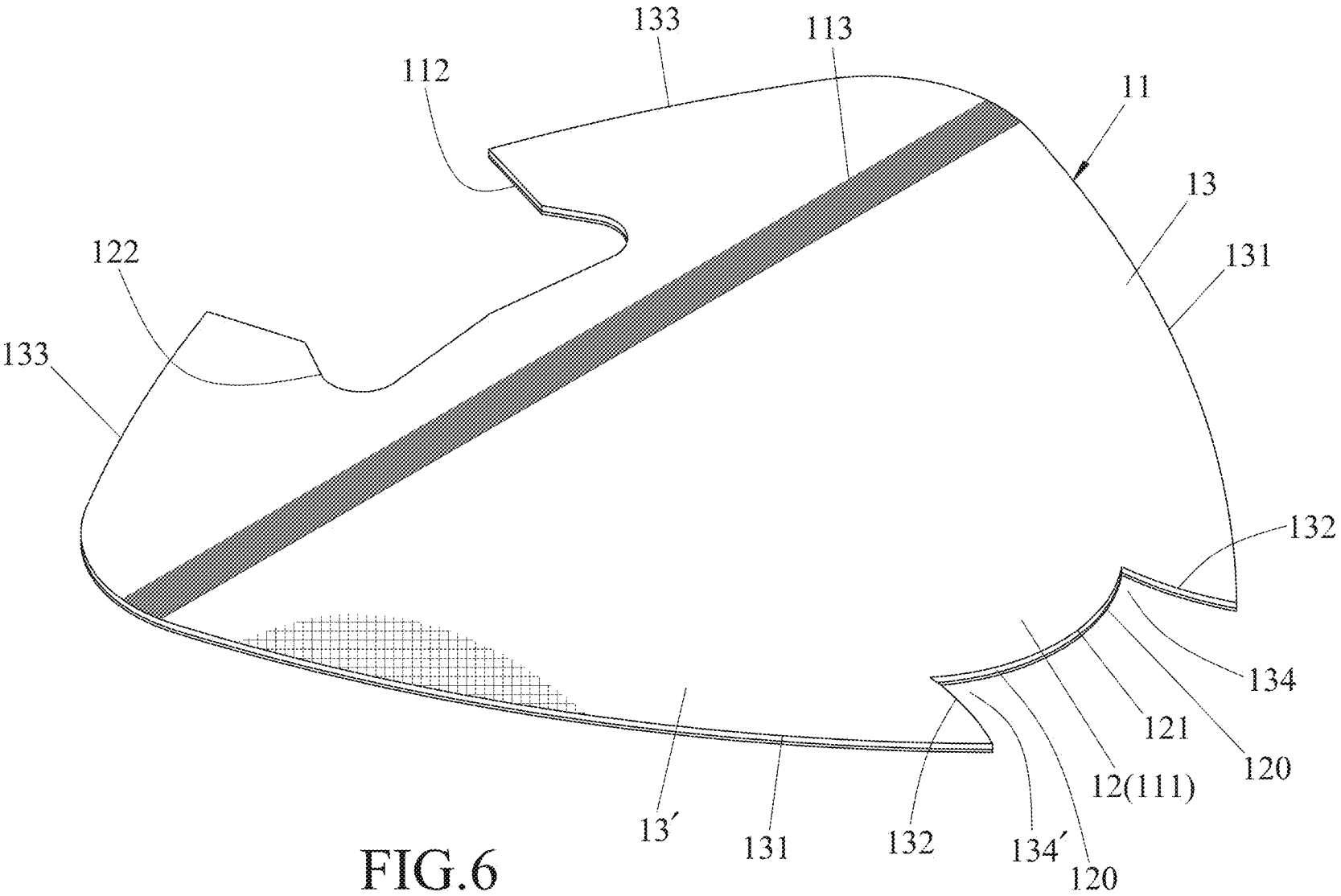
FIG. 6 is a perspective view of the cut piece.

In step 530, as shown in FIGS. 1, 5, and 6, a piece 11 is cut from the laminate 100 for forming a shoe upper unit 10. The cut piece 11 has a knitted component Ill from the knitted fabric 110, an adhesive component 112 from the adhesive layer 130, and a pattern 113 from the transfer-printed pattern 120 (see also FIG. 4).

In an embodiment shown in FIG. 6, the cut piece 11 includes a left segment 13, a right segment 13', and a middle segment 12 which is flanked by the left and right segments 13, 13'. The left and right segments 13, 13' may be arranged symmetrically at two opposite sides of the middle segment 12. The middle segment 12 has a front marginal region 121 and a rear opening-defining marginal edge 122. The front marginal region 121 has a left cutout zone 134 and a right cutout zone 134', each of which is defined by a first toe-side edge 120 and a second toe-side edge 132 that converge toward each other. Each of the left and right segments 13, 13' has a sole-side edge 131 and a heel-side edges 133. The first toe-side edge 120 of the left and right cutout zones 134, 134' defines a continuous curved margin. The second toe-side edge 132 of each of the left and right cutout zones 134, 134' defines a length substantially equal to a half of a length defined by the continuous curved margin.

Figure 7:
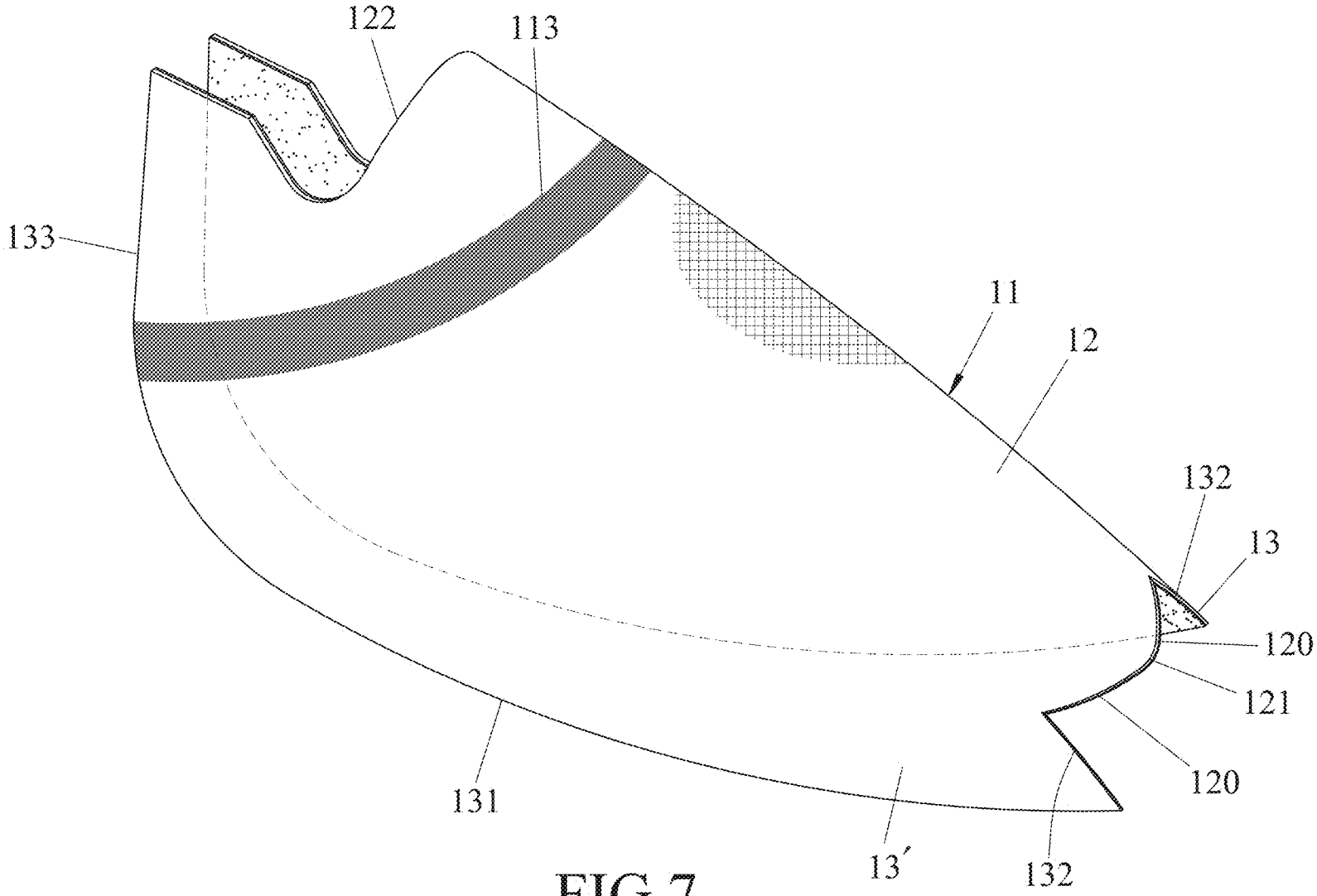
FIG. 7 is a perspective view illustrating the cut piece bent for stitching.
Figure 8:
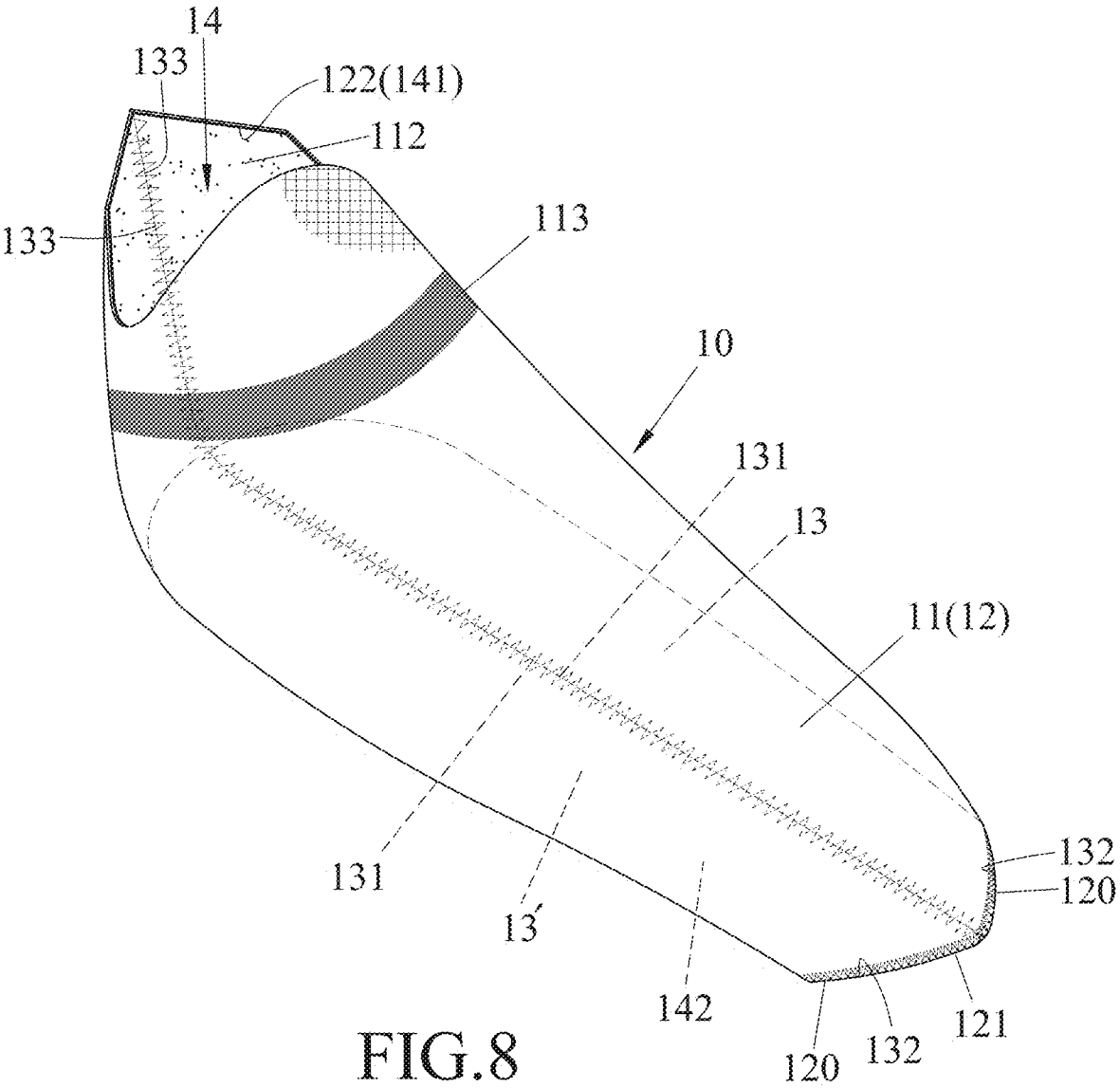
FIG. 8 is a perspective view of a shoe upper unit made from the cut piece in the process of the first embodiment.

In step 540, as shown in FIGS. 1, 7, and 8, the cut piece 11 is formed into the shoe upper unit 10 in such a manner that the shoe upper unit 10 has a first ankle opening 141 and a first closed bottom 142, that the adhesive component 112 constitutes an inner surface of the shoe upper unit 10 which defines an inner space 14, and that the shoe upper unit 10 has the pattern 113 from the transfer printed pattern 120 on an outer surface thereof.

In an embodiment shown in FIGS. 6 to 8, step 540 is implemented by bonding (stitching) the first toe-side edge 120 to the second toe-side edge 132 of each of the left and right cutout zones 134, 134', and bonding (stitching) the sole-side edge 131 and the heel-side edge 133 of the left segment 13 to the sole-side edge 131 and the heel-side edge 133 of the right segment 13', to permit the rear opening-defining marginal edge 122 to define the first ankle opening 141, thereby obtaining the shoe upper unit 10. The first and second toe-side edges 120, 132 are positioned at a front side of the shoe upper unit 10, the heel-side edges 133 are positioned at a rear side of the shoe upper unit 10, and the sole-side edges 131 are positioned at a bottom side of the shoe upper unit 10.

Figure 9:
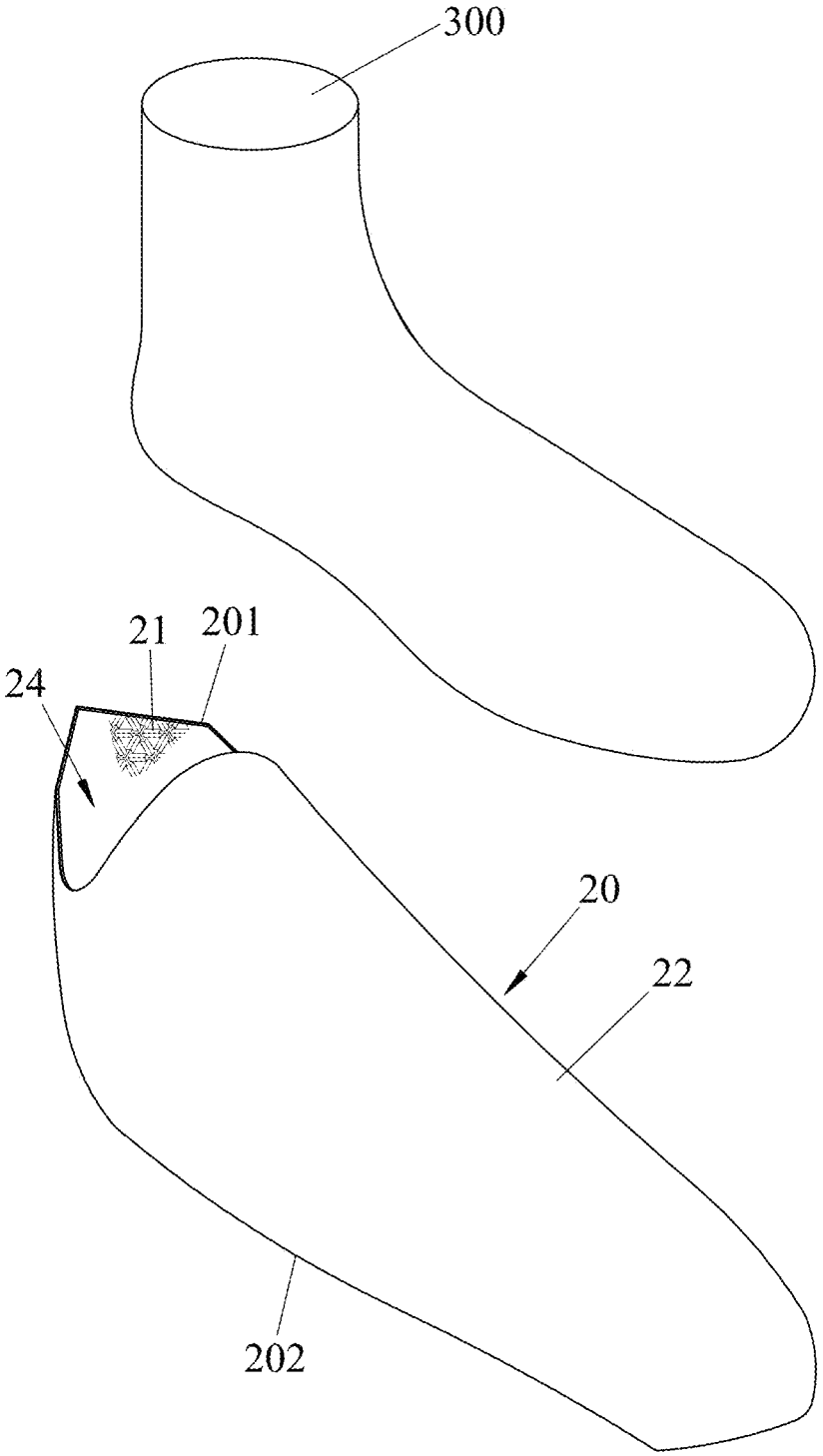
FIG. 9 is a perspective view showing a last and a shoe lining member used in the process of the first embodiment.
Figure 10:
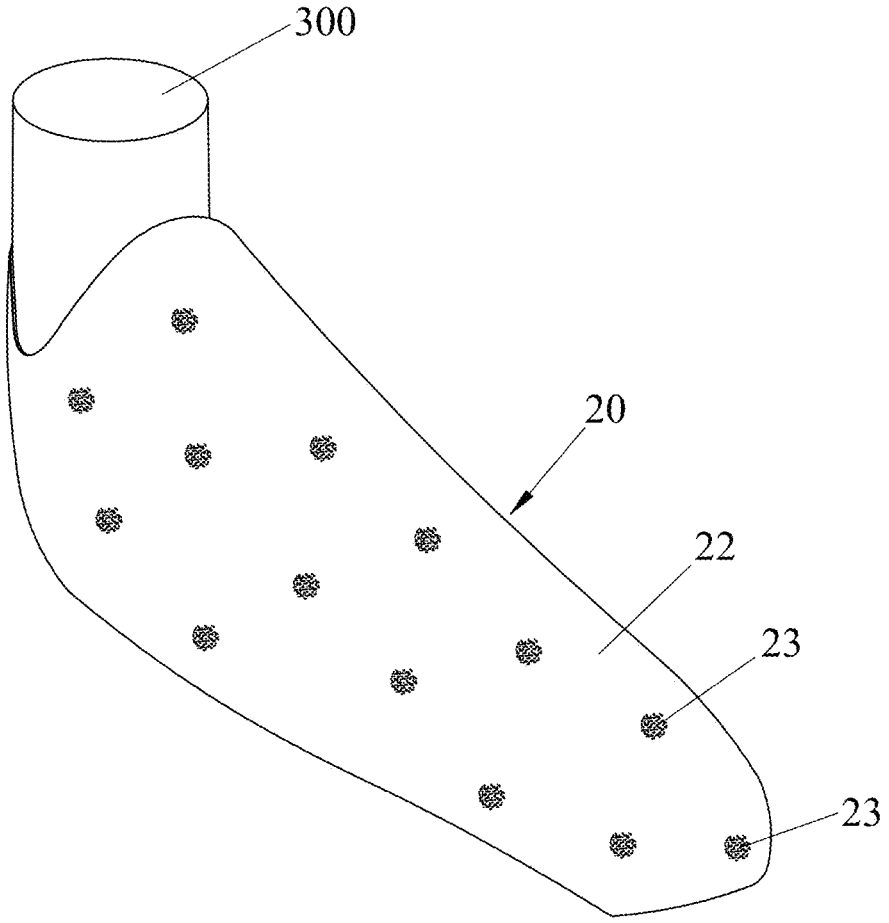
FIG. 10 is a perspective view showing the shoe lining member worn on the last in the process of the first embodiment.
Figure 11:
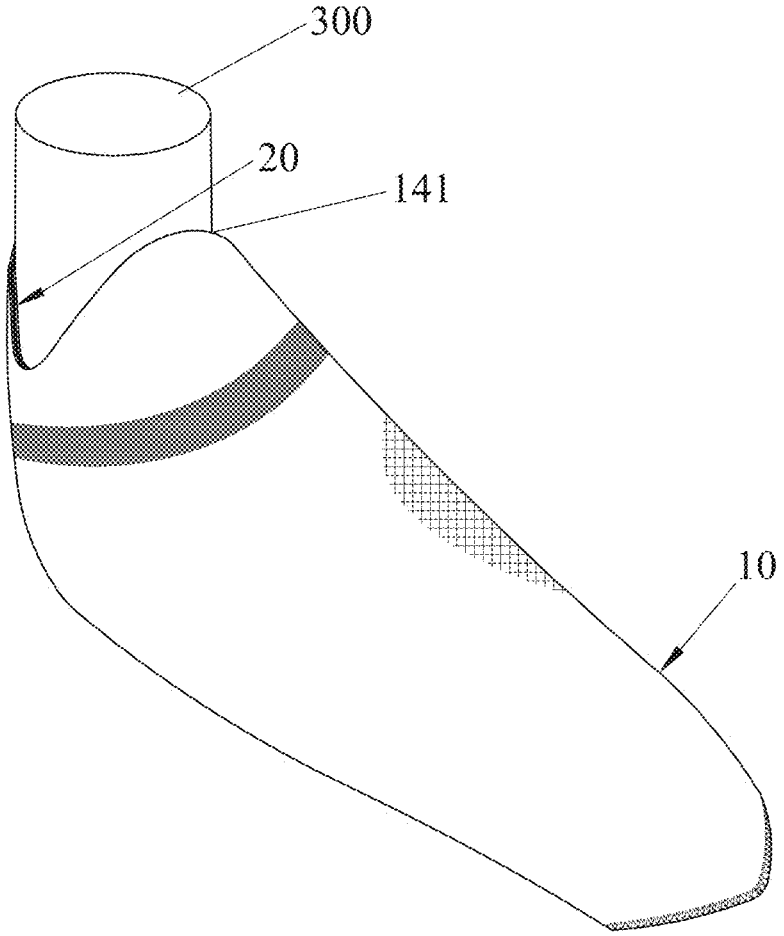
FIG. 11 is similar to FIG. 10 but illustrating the shoe upper unit worn on the shoe lining member in the process of the first embodiment.

In step 550, as shown in FIGS. 1, 9, 10, a shoe lining member 20 and a last 300 are prepared, and the shoe lining member 20 is worn on the last 300 to permit the shoe lining member 20 to have an outer profile corresponding to an inner profile of shoe upper unit 10. The shoe member 20 has a second ankle opening 201 and a second closed bottom 202, and defines therein an inner space 24. The shoe lining member 20 includes a shoe lining layer 21 and a waterproof and vapor-permeable layer 22 which is disposed outwardly of the shoe lining layer 22 to define the outer profile of the shoe lining member 20.

In an embodiment, the waterproof and vapor-permeable layer 22 may be made from, but is not limited to, polyurethane.

In step 560, as shown in FIGS. 1 and 10, an adhesive is dispensed on an outer surface of the shoe lining member 20 to form a plurality of adhesive spots 23 on the outer surface of the shoe lining member 20 so as to enhance the bonding between the shoe upper unit 10 and the shoe lining member 20. The dispensed adhesive may be, but is not limited to, a moisture-curing hot-melt adhesive.

In step 570, as shown in FIGS. 1 and 11 to 13, the shoe lining member 20, which is worn on the last 300, is placed into the shoe upper unit 10 through the first ankle opening 141 to permit the waterproof and vapor-permeable layer 22 to be in contact with the adhesive component 112.

In an embodiment, step 570 is implemented under vacuum so as to permit removal of air between the waterproof and vapor-permeable layer 22 and the adhesive component 112, thereby enhancing adhesion between the shoe upper unit 10 and the shoe lining member 20.

Figure 12:
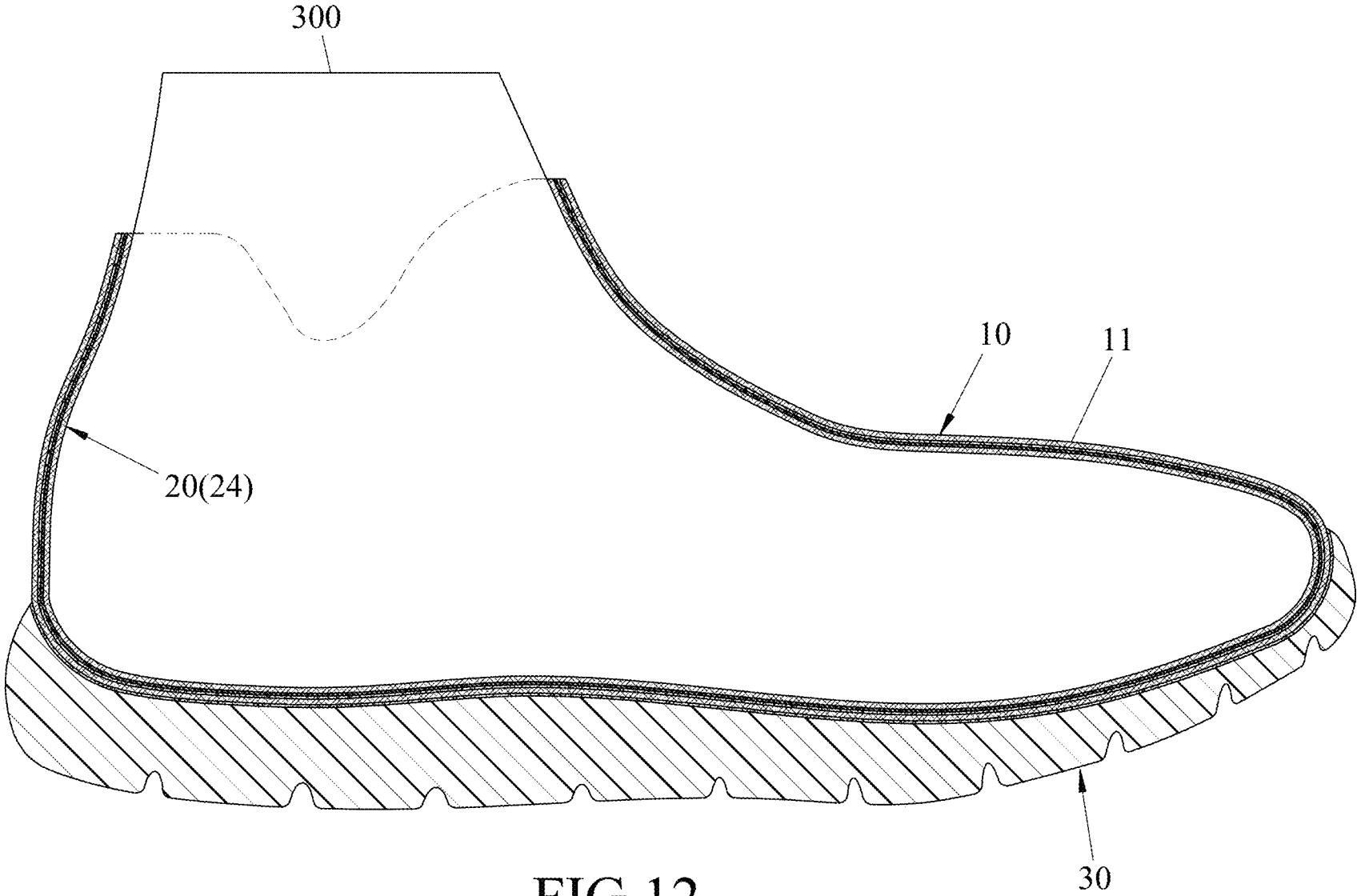
FIG. 12 is partial cross-section view of FIG. 11.
Figure 13:
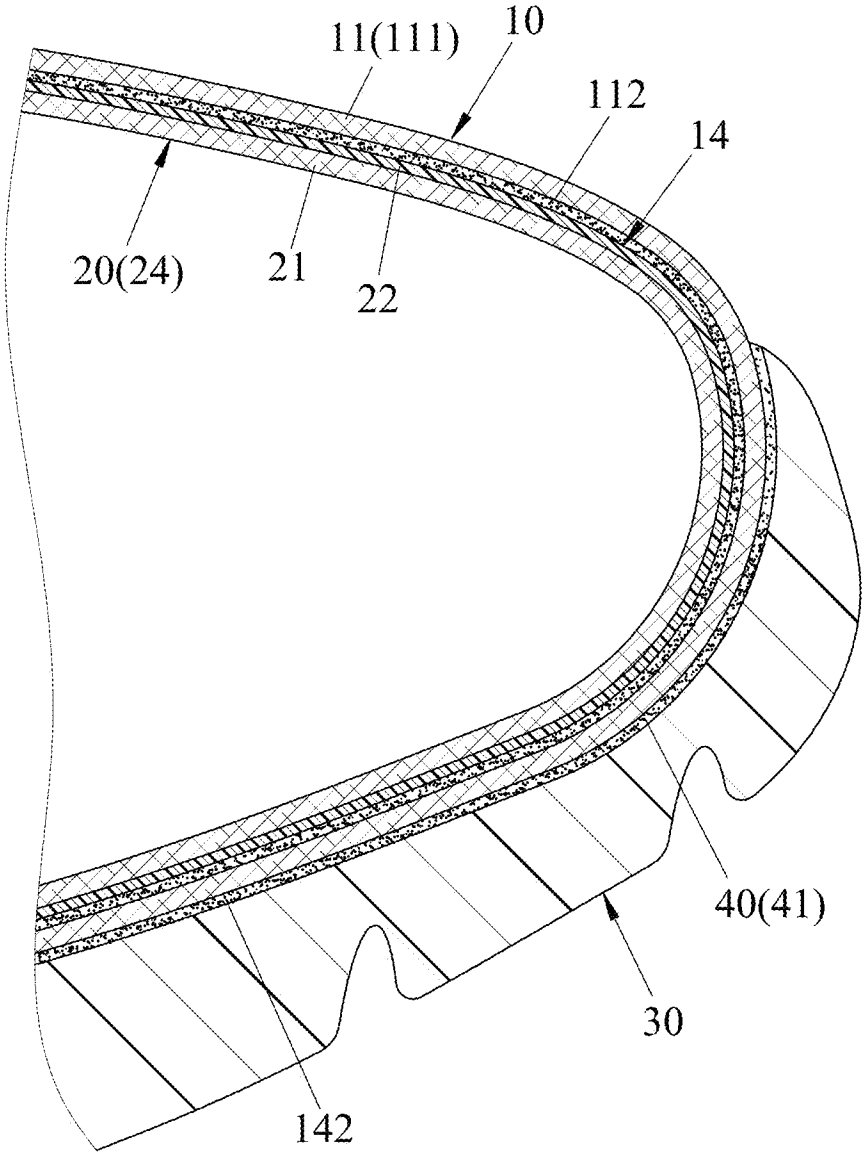
FIG. 13 is a fragmentary enlarged view of FIG. 12.

In step 580, as shown in FIGS. 1, 12, and 13, the shoe upper unit 10 and the shoe lining member 20 are heated to permit the adhesive component 112 to bond the waterproof and vapor-permeable layer 22 and the knitted component 111 together.

In an embodiment, step 580 is implemented by placing the shoe upper unit 10, which is worn on the shoe lining member 20 and the last 300, into an oven (not shown) which is set at a temperature ranging from 110° C. to 160° C. so as to permit the adhesive spots 23 and the adhesive component 112 to fuse together, thereby facilitate the adhesion between the shoe upper unit 10 and the shoe lining member 20.

In other embodiments, step 560 may be omitted, and the waterproof and vapor-permeable layer 22 may be bonded to the knitted component 111 by virtue of the adhesive component 112 only.

In yet another embodiment, taking the material of the knitted fabric 110 into consideration, the adhesive layer 130 may not be formed on the knitted fabric 110, and the cut piece 11 may include the knitted component 111 only. In this case, the shoe upper unit 10 and the shoe lining member 20 may be bonded to each other by virtue of the adhesive spots 23 or an adhesive coating (not shown) which is coated on the outer surface of the shoe lining member 20.

In step 590, as shown in FIGS. 1, 12, and 13, a sole unit 30 is bonded to the first closed bottom 142 of the shoe upper unit 10.

In an embodiment shown in FIG. 13, the sole unit 30 is bonded to the first closed bottom 142 of the shoe upper unit 10 using an adhesive 40, which is cured to form an adhesive layer 41.

Figure 14:
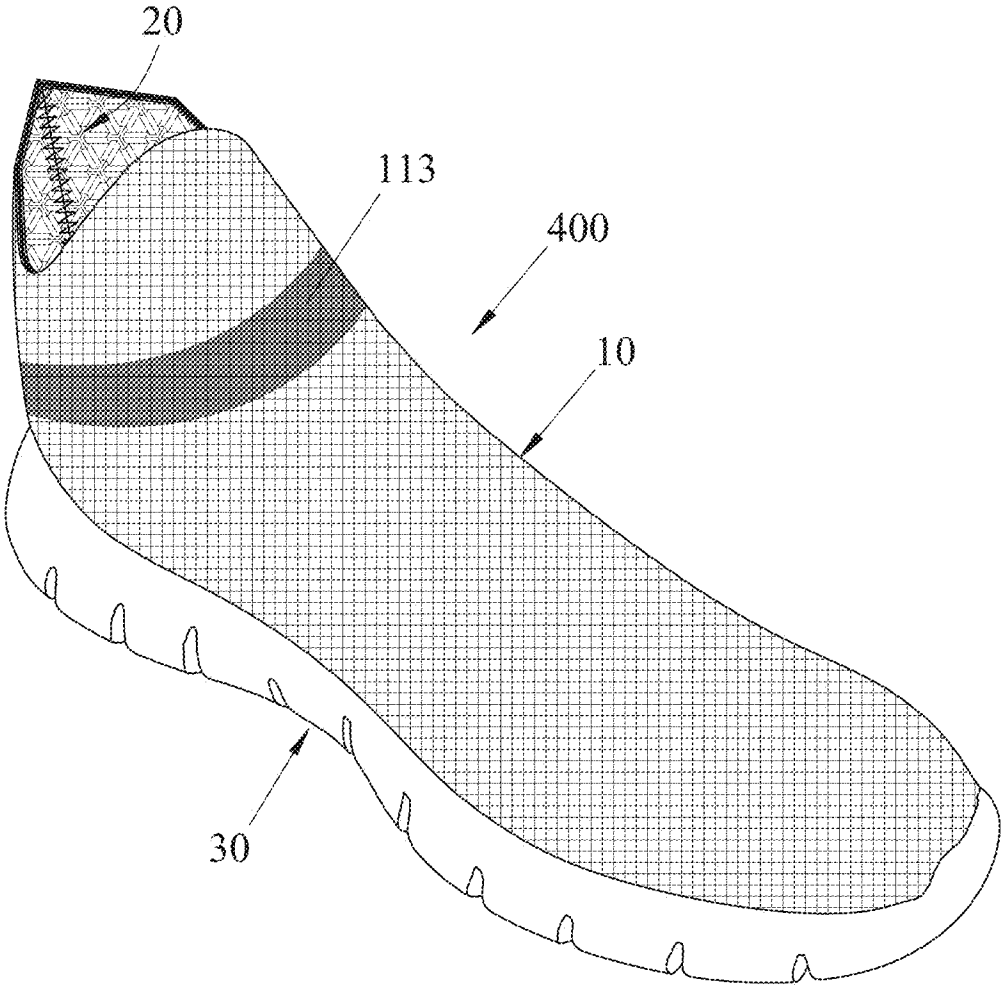
FIG. 14 is a perspective view of the waterproof and vapor-permeable shoe obtained by the process of the first embodiment.

In step 600, as shown in FIGS. 1, 12, and 14, the last 300 is removed from the shoe lining member 20, and the waterproof and vapor-permeable shoe 400 is obtained.

The process of the disclosure has the following effects and advantages:

Because the adhesive layer 130 (the adhesive component 112) is formed on the knitted fabric 110 (the knitted component 111) prior to the cutting step (step 530), the knitted component 112 of the shoe upper unit 10 can be bonded to the shoe lining member 20 through the adhesive component 112 without using a spraying adhesive. Thus, the process of the disclosure is environmentally friendly.

In addition, the shoe upper unit 10 can be formed by stitching the cut piece 11, which has the transfer-printed pattern 113, into a three dimension structure. Therefore, compared to the conventional shoe upper unit with a computer knitted pattern, the shoe upper unit 10 can be formed more effectively with a relative low production cost.

Figure 15:
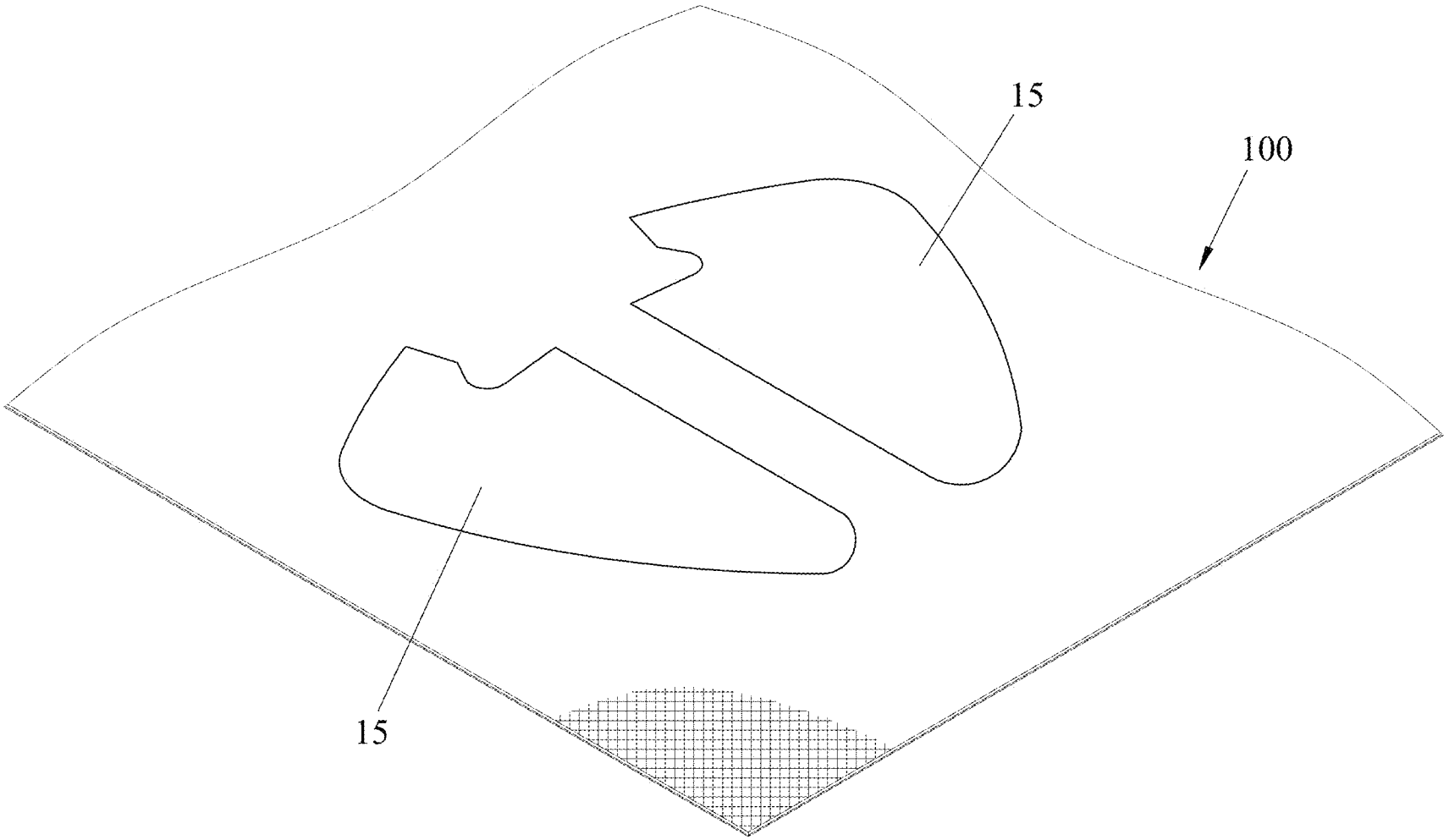
FIG. 15 is similar to FIG. 5 but illustrating prof es of two pieces cut from the laminate in a process according to a second embodiment of the disclosure.

Referring to FIGS. 1 and 15, a process for manufacturing a waterproof and vapor-permeable shoe 400 (shown in FIG. 14) according to a second embodiment of the disclosure is similar to the first embodiment except that:

Step 530 is implemented by cutting two pieces 15 from the laminate 100 for forming the shoe upper unit 10. Each of the two cut pieces 15 has an opening-defining edge 151, an instep-side edge 152, a heel side edge 155, and a sole-side edge 156.

Figure 16:
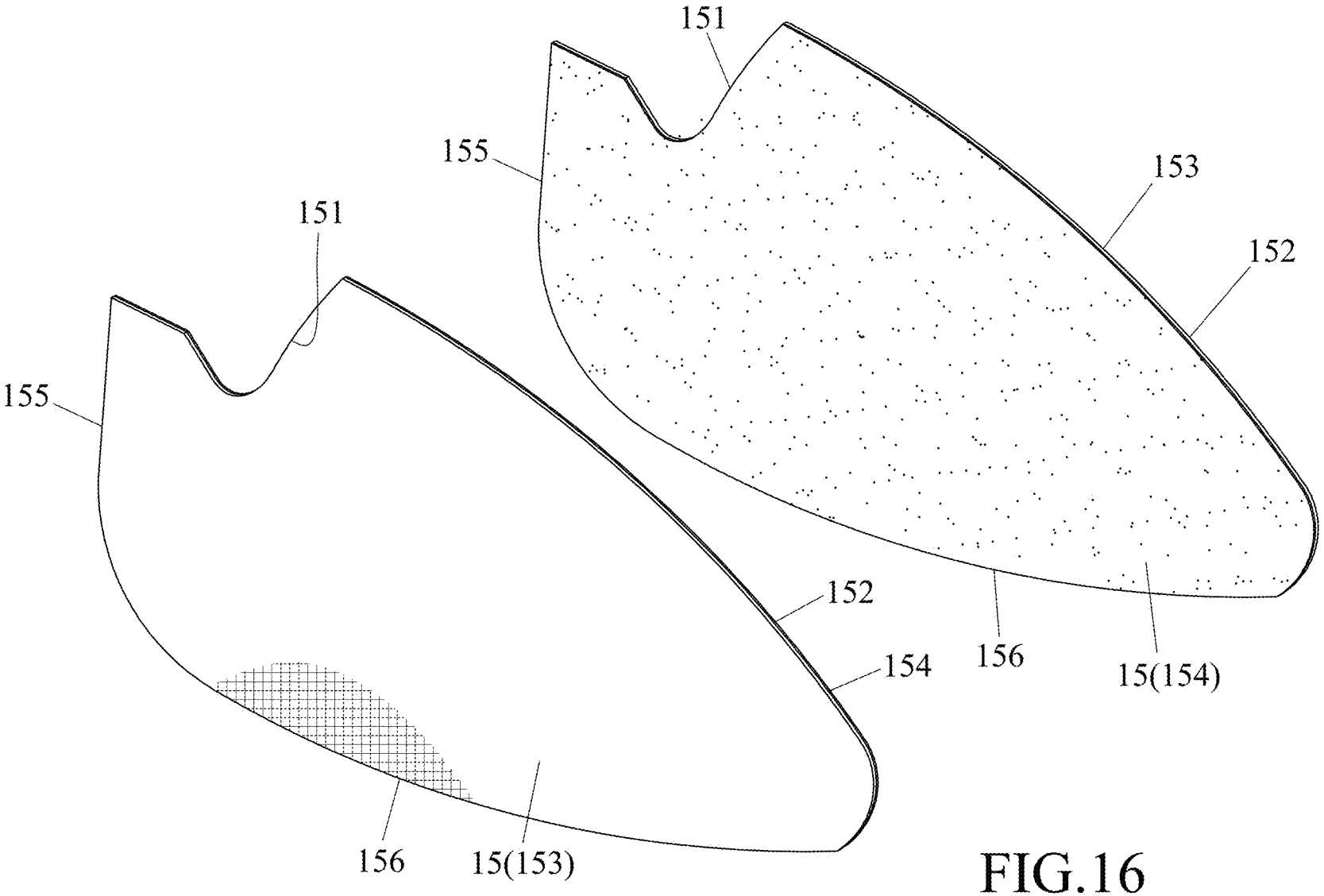
FIG. 16 is a perspective view of the two cut pieces cut from the laminate in the process of the second embodiment.
Figure 17:
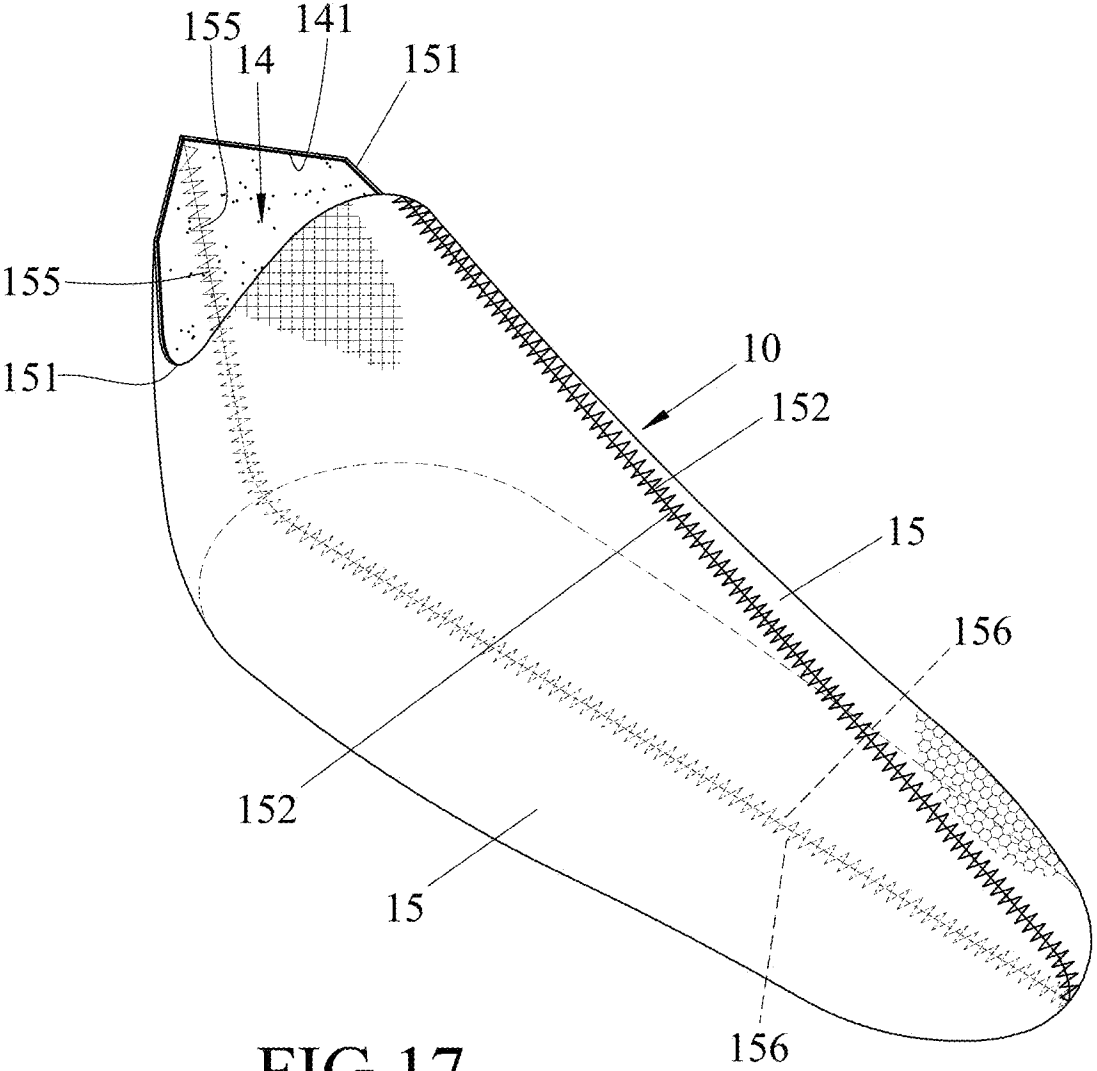
FIG. 17 is a perspective view of a shoe upper unit made from the two cut pieces in the process of the second embodiment.

Step 540 is implemented by bonding (stitching) the instep-side edges 152, the heel side edges 155, and the sole-side edges 156 of the two pieces 15 to each other, to permit the opening-defining edges 151 of the two pieces 15 to define the first ankle opening 141, thereby obtaining the shoe upper unit 10 (see FIGS. 16 and 17).

In addition, each of the cut pieces 15 includes a knitted component 153 and an adhesive component 154. The cut pieces 15 may have different colors or different patterns to permit the shoe upper unit 10 to have a multi-colored or multi-patterned appearance.

The process of the second embodiment has effects and advantages similar to those of the first embodiment.

Figure 18:
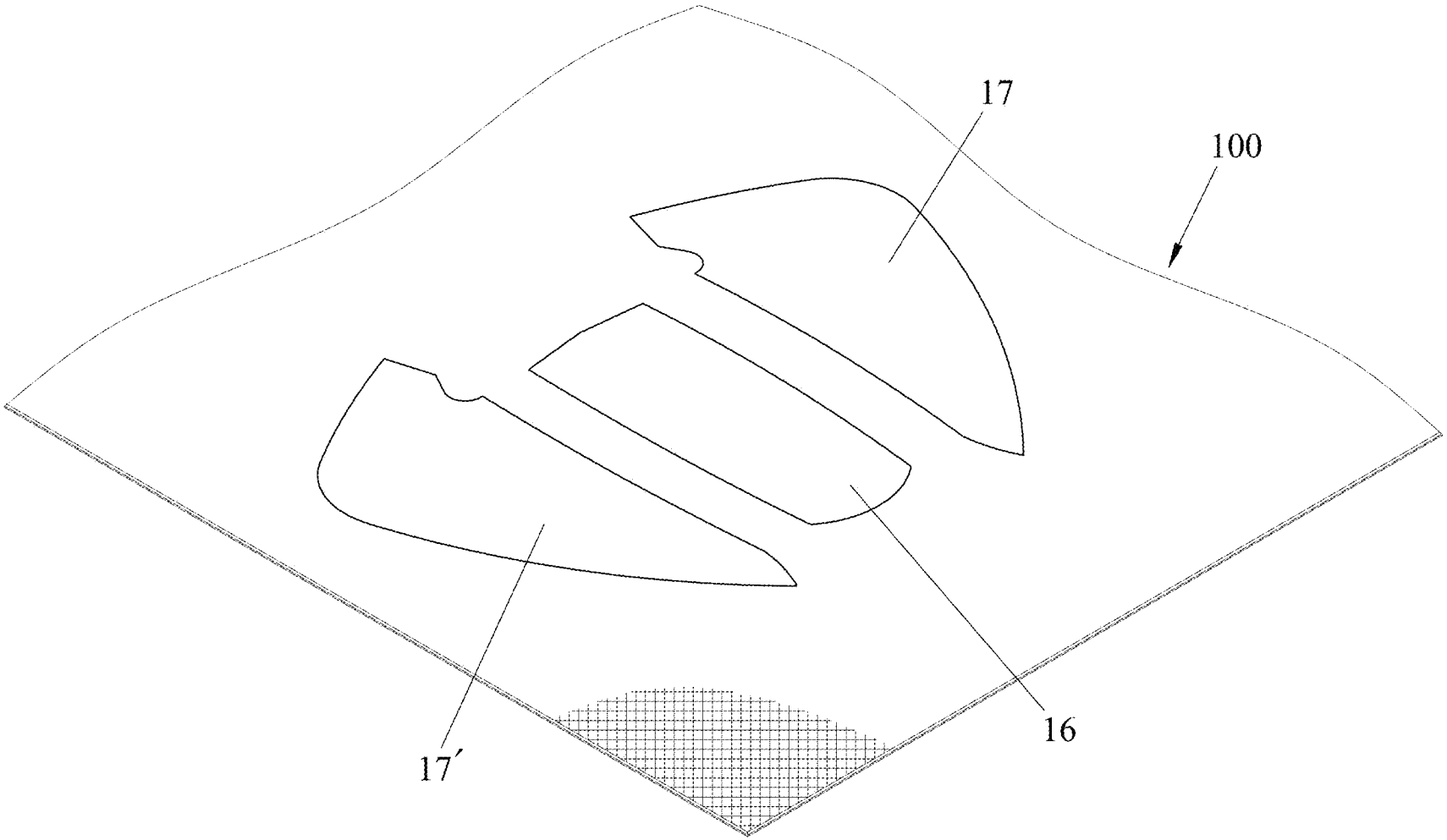
FIG. 18 is similar to FIG. 5 but illustrating profiles of three pieces cut from the laminate in a process according to a third embodiment of the disclosure.
Figure 19:
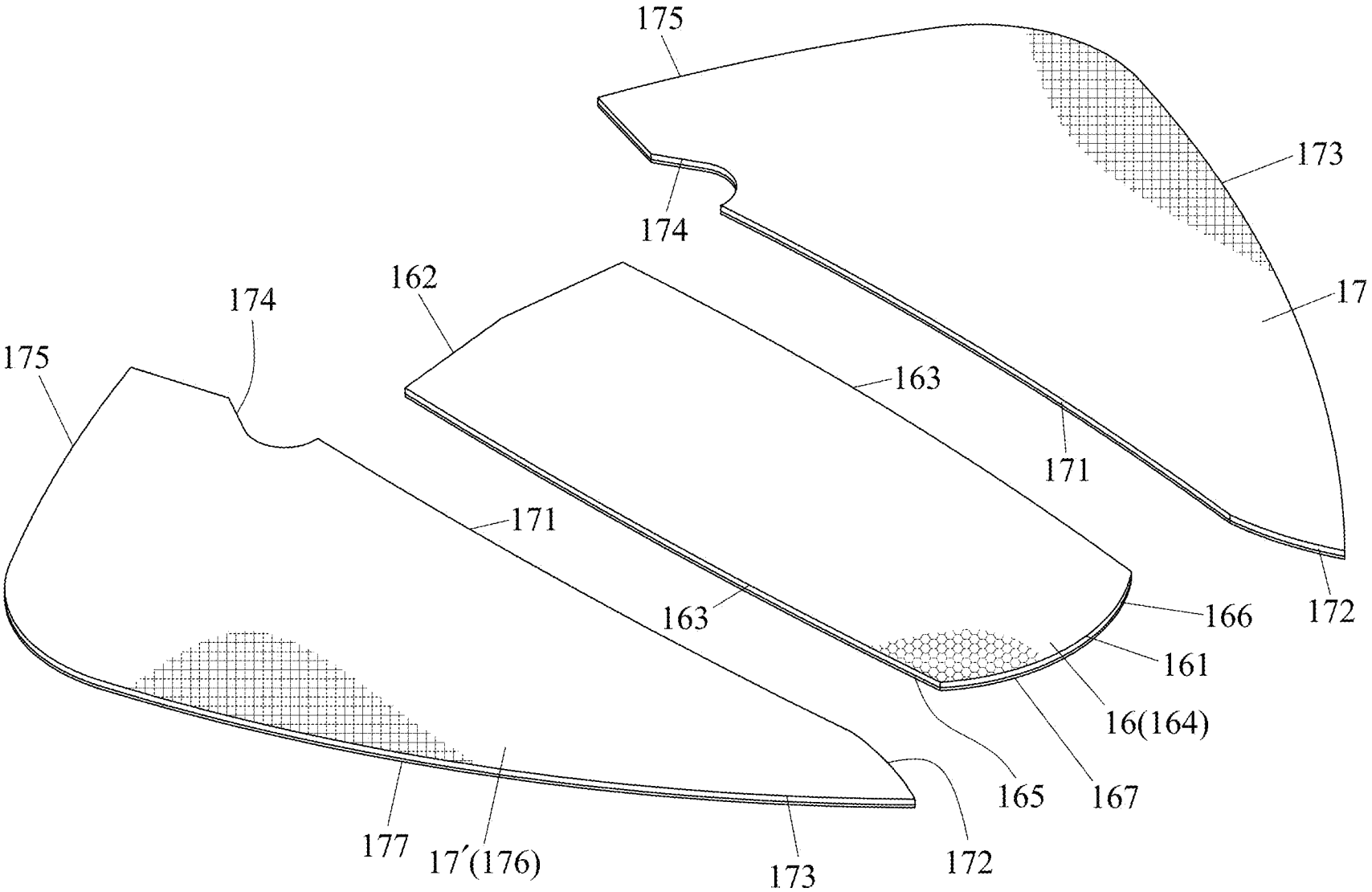
FIG. 19 is a perspective view of the three cut pieces (an upper piece, a left piece, and a right piece) cut from the laminate in the process of the third embodiment.
Figure 20:
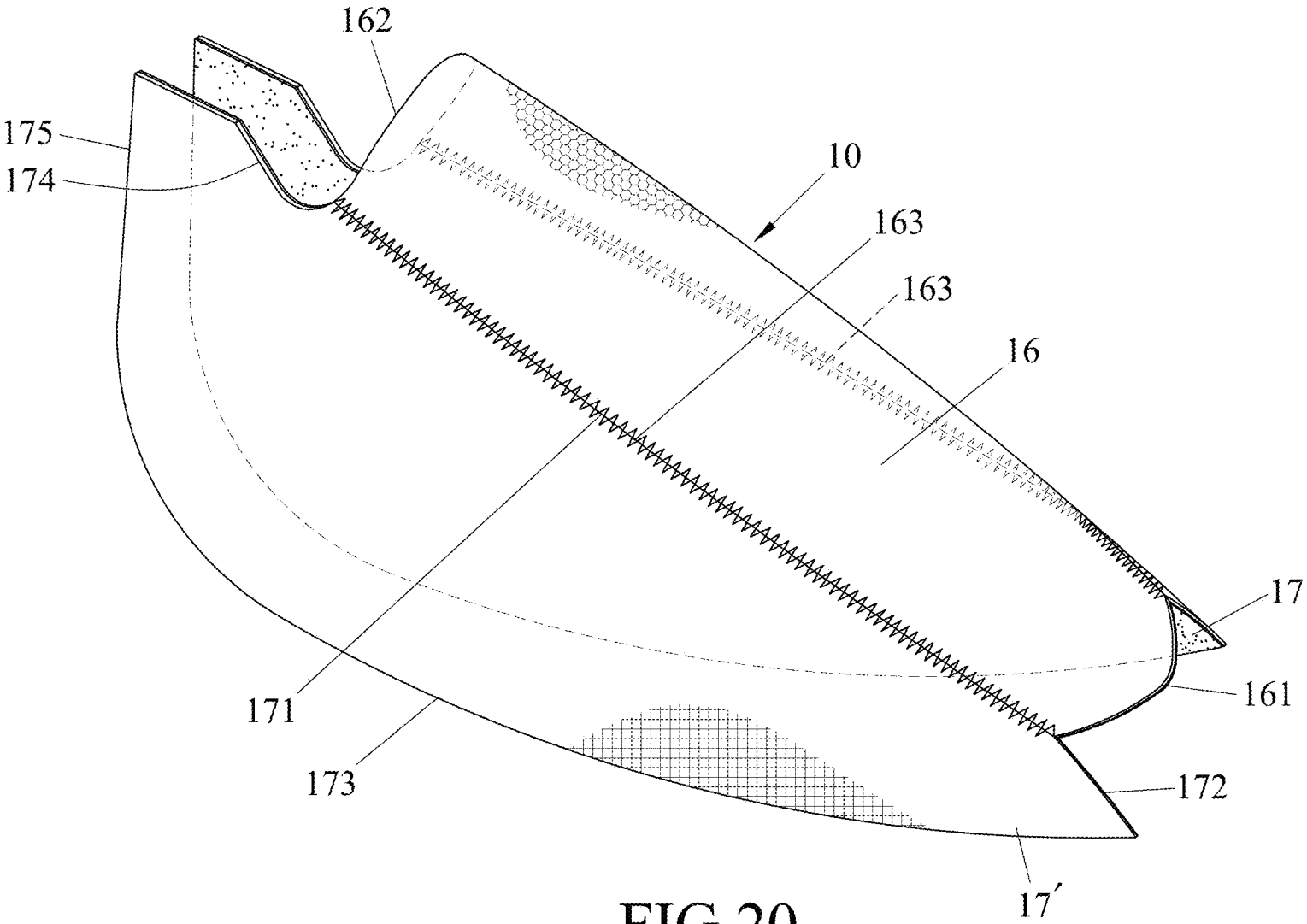
FIG. 20 is a perspective view illustrating that the left and right pieces stitched to the upper piece in the process of the third embodiment.
Figure 21:
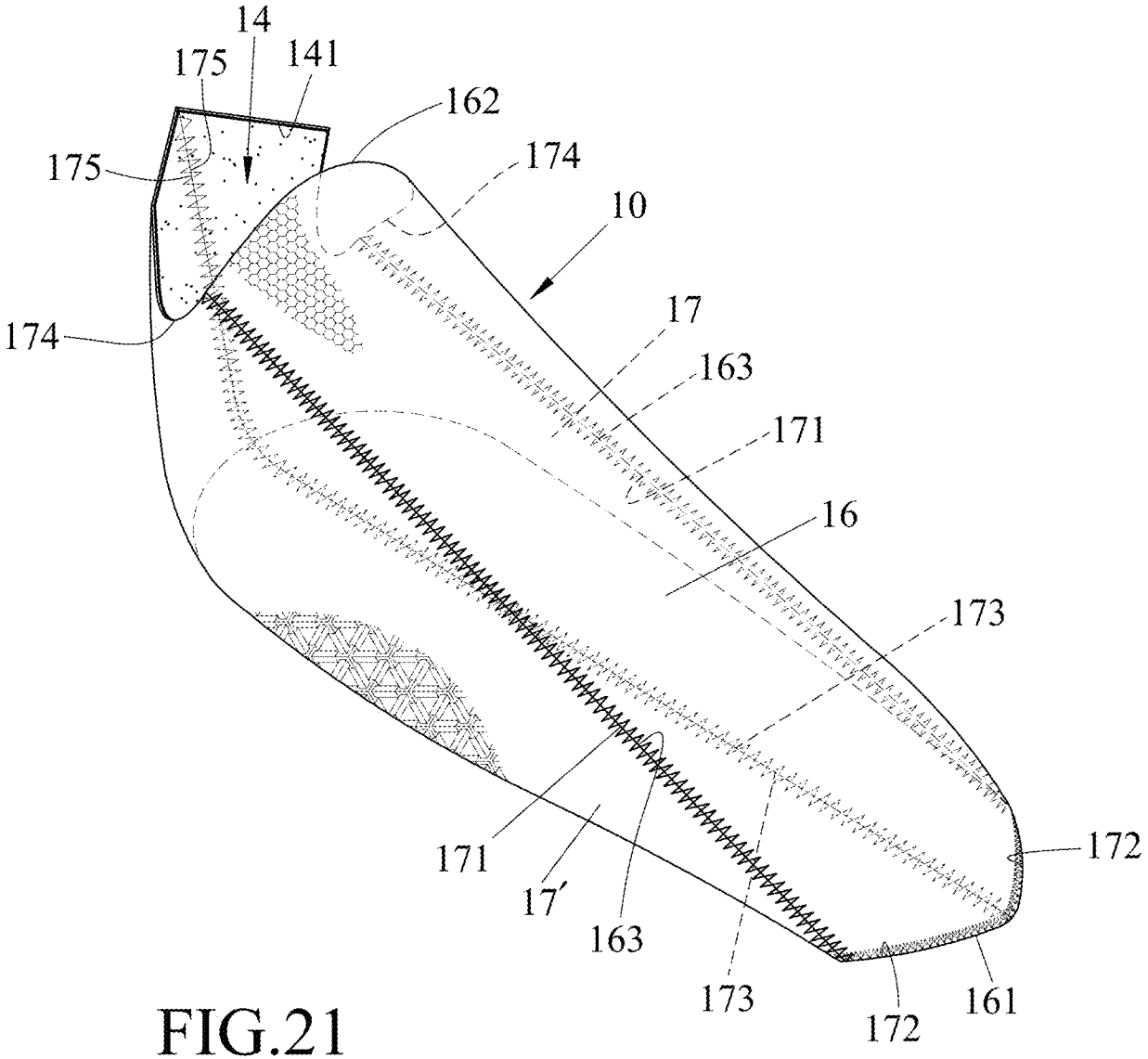
FIG. 21 is a perspective view of a shoe upper unit made from the upper, left, and right pieces in the process of the third embodiment.

Referring to FIGS. 1 and 18, a process for manufacturing a waterproof and vapor-permeable shoe 400 (shown in FIG. 14) according to a third embodiment of the disclosure is similar to the first embodiment except that:

Step 530 is implemented by cutting three pieces 16, 17, 17' (an upper piece 16, a left piece 17, and a right piece 17') from the laminate 100 for forming the shoe upper unit 10 (see FIGS. 1, 18, and 19).

The upper piece 16 has a front marginal region 161 a rear opening-defining edge 162, and a pair of first connection edges 163. The front marginal region 161 has a left toe-side edge 166 and a right toe-side edge 167. Each of the first connection edges 163 connects a respective one of the left and right toe-side edges 166, 167 and the rear opening-defining edge 162.

Each of the left and right pieces 17, 17' has a third toe-side edge 172, a first opening-defining edge 174, a heel-side edge 175, a sole side edge 173, and a second connection edge 171 which connects the third toe-side edge 172 and the first opening-defining edge 174.

Step 540 is implemented by bonding (stitching) the left and right toe-side edges 166, 167 respectively to the third toe-side edges 172 of the left and right pieces 17, 17', bonding (stitching) the first connection edges 163 to the second connection edges 171 of the left and right pieces 17, 17', and bonding (stitching) the sole-side edge 173 and the heel-side edge 175 of the left piece 17 respectively to the sole-side edge 173 and the heel-side edge 175 of the right piece 17' to permit the rear opening-defining marginal edge 162 of the upper piece 16 and the first opening-defining edges 174 of the left and right pieces 17, 17' to cooperatively define the first ankle opening 141, thereby obtaining the shoe upper unit 10.

In addition, the upper piece 16 includes a knitted component 164 and an adhesive component 165, and each of the left and right pieces 17, 17' includes a knitted component 176 and an adhesive component 177. The upper, left, and right pieces 16, 17, 17 may have different colors or different patterns to permit the shoe upper unit 10 to have a multi-colored or multi-patterned appearance.

The process of the third embodiment has effects and advantages similar to those of the first embodiment.

In sum, the process of the disclosure avoids environmental problem of the spraying adhesive, and is useful for the lowering of the manufacturing cycle time and the reduction of the production cost.

In the description above, for the purposes of explanation, numerous specific details have been set forth in order to provide a thorough understanding of the embodiment (s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A process for manufacturing a waterproof and vapor-permeable shoe, comprising the steps of:

(a) providing an adhesive layer on a first major surface of a knitted fabric to form a laminate;

(b) cutting from the laminate at least one piece for forming a shoe upper unit, the at least one piece having a knitted component and an adhesive component;

(c) forming the at least one piece into the shoe upper unit in such a manner that the shoe upper unit has a first ankle opening and a first closed bottom, and that the adhesive component constitutes an inner surface of the shoe upper unit which defines an inner space;

(d) wearing a shoe lining member on a last to permit the shoe lining member to have an outer profile corresponding to an inner profile of shoe upper unit, the shoe lining member having a second ankle opening and a second closed bottom, and including a shoe lining layer and a waterproof and vapor-permeable layer which is disposed outwardly of the shoe ng layer to define the outer profile of the shoe lining member;

(e) placing the shoe lining member, which is worn on the last, into the shoe upper unit through the first ankle opening to permit the waterproof and vapor-permeable layer to be in contact with the adhesive component;

(f) heating the shoe upper unit and the shoe lining member to permit the adhesive component to bond the waterproof and vapor-permeable layer and the knitted component together; and (g) bonding a sole unit to the first closed bottom of the shoe upper unit.

2. The process according to claim 1, before step (a), further comprising, a step (a1) of forming transfer-printed pattern on a second major surface of the knitted fabric which is opposite to the first major surface, using a transfer printing technique, so as to permit the shoe upper unit to have the transfer printed pattern on an outer surface thereof.

3. The process according to claim 1, wherein step (a) is implemented by applying adhesive material on the first major surface of the knitted fabric to form the adhesive layer.

4. The process according to claim 3, further comprising, between steps (a) and (b), a step (b1) of drying the adhesive layer.

5. The process according to claim 4, wherein the adhesive material includes polyurethane adhesive, and the adhesive layer in step (b1) is dried at a temperature ranging from 90° C. to 160° C. for a time period ranging from 3 minutes to 5 minutes.

6. The process according to claim 4, wherein the adhesive material includes polyurethane adhesive, and the adhesive layer in step (b1) is dried at room temperature for 24 hours.

7. The process according to claim 1, wherein the adhesive layer is a hot-melt film adhesive.

8. The process according to claim 1, further comprising, between steps (d) and (e), a step (e1) of dispensing a moisture-curing hot-melt adhesive on an outer surface of the shoe lining member to form a plurality of adhesive spots on the outer surface of the shoe lining member so as to enhance the bonding between the shoe upper unit and the shoe lining member.

9. The process according to claim 1, wherein step (e) is implemented under vacuum.

10. The process according to claim 1, wherein, step (b) is implemented by cutting a single one of the piece for forming the shoe upper unit, the cut piece including a left segment, a right segment, and a middle segment which is flanked by the left and right segments, and which has a front marginal region and a rear opening-defining marginal edge, the front marginal region having a left cutout zone and a right cutout zone, each of which is defined by a first toe-side edge and a second toe-side edge that converge toward each other, each of the left and right segments having a sole-side edge and a heel-side edges; and step (c) is implemented by bonding the first toe-side edge to the second toe-side edge of each of the left and right cutout zones, and bonding the sole-side edge and the heel-side edges of the left segment to the sole-side edge and the heel-side edges of the right segment, to permit the rear opening-defining marginal edge to define the first ankle opening, thereby obtaining the shoe upper unit.

11. The process according to claim 1, wherein, step (b) is implemented by cutting two of the pieces for forming the shoe upper unit, each of the two pieces having an opening-defining edge, an instep-side edge, a heel side edge, and a sole-side edge; and step (c) is implemented by bonding the instep-side edges, the heel side edges, and the sole-side edges of the two pieces to each other, to permit the opening-defining edges of the two pieces to define the first ankle opening, thereby obtaining the shoe upper unit.

12. The process according to claim 1, wherein, step (b) is implemented by cutting three of the pieces for forming the shoe upper unit, the three pieces being defined as an upper piece haying a front marginal region which has a left toe-side edge and a right toe-side edge, a rear opening-defining edge, and a pair of first connection edges each of which connects a respective one of said left and right toe-side edges and the rear opening-defining edge, and a left piece and a right piece, each of which has a third toe-side edge, a first opening-defining edge, a heel-side edge, a sole side edge, and a second connection edge which connects the third toe-side edge and the first opening-defining edge; and step (c) is implemented by bonding the left and right toe-side edges respectively to the third toe-side edges of the left and right pieces, the first connection edges to the second connection edges of the left and right pieces, and the sole-side edge and the heel-side edge of the left piece respectively to the sole-side edge and the heel-side edge of the right piece, to permit the rear opening-defining marginal edge of the upper piece and the first opening-defining edges of the left and right pieces to cooperatively define the first ankle opening, thereby obtaining the shoe upper unit.

* * * * *